US008840205B2

(12) United States Patent
Chellappan et al.

(10) Patent No.: US 8,840,205 B2
(45) Date of Patent: Sep. 23, 2014

(54) REFRIGERATOR APPLIANCE AND A SHELF ASSEMBLY FOR THE SAME

(71) Applicant: General Electrical Company, Schenectady, NY (US)

(72) Inventors: Bagawathkumar Chellappan, Louisville, KY (US); Louis Anthony Wantland, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/774,003

(22) Filed: Feb. 22, 2013

(65) Prior Publication Data

US 2014/0239792 A1 Aug. 28, 2014

(51) Int. Cl.
*A47B 96/04* (2006.01)
*F25D 23/06* (2006.01)

(52) U.S. Cl.
CPC ..... *F25D 23/067* (2013.01)
USPC ..... 312/408; 108/93

(58) Field of Classification Search
USPC ..... 312/408, 401, 410; 108/108, 109, 63, 108/96, 17, 65
See application file for complete search history.

(56) References Cited

U.S. PATENT DOCUMENTS

| | | | | |
|---|---|---|---|---|
| 2,465,806 | A * | 3/1949 | Jewell | 211/153 |
| 3,311,072 | A * | 3/1967 | Pattison | 108/143 |
| 3,859,932 | A * | 1/1975 | Armstrong et al. | 108/75 |
| 4,620,489 | A * | 11/1986 | Albano | 108/105 |
| 5,813,741 | A * | 9/1998 | Fish et al. | 312/408 |
| 6,357,609 | B1 * | 3/2002 | Van Noord et al. | 211/90.02 |
| 8,403,438 | B2 * | 3/2013 | Park et al. | 312/408 |
| 8,740,322 | B2 * | 6/2014 | Moon et al. | 312/408 |
| 2007/0228909 | A1 * | 10/2007 | Hwang et al. | 312/408 |
| 2009/0250420 | A1 * | 10/2009 | Martin et al. | 211/134 |
| 2010/0109498 | A1 * | 5/2010 | Ramm et al. | 312/408 |
| 2011/0001415 | A1 | 1/2011 | Park et al. | |
| 2013/0020922 | A1 * | 1/2013 | Jang | 312/408 |

* cited by examiner

*Primary Examiner* — Daniel Rohrhoff
(74) *Attorney, Agent, or Firm* — Dority & Manning, P.A.

(57) ABSTRACT

A shelf assembly for a refrigerator appliance is provided. The shelf assembly includes a pair of brackets, a fixed shelf mounted to the pair of brackets, and a movable shelf. The shelf assembly also includes features for slidably mounting the movable shelf to said fixed shelf and for limiting movement of the movable shelf along a transverse direction.

17 Claims, 7 Drawing Sheets

FIG. –1–

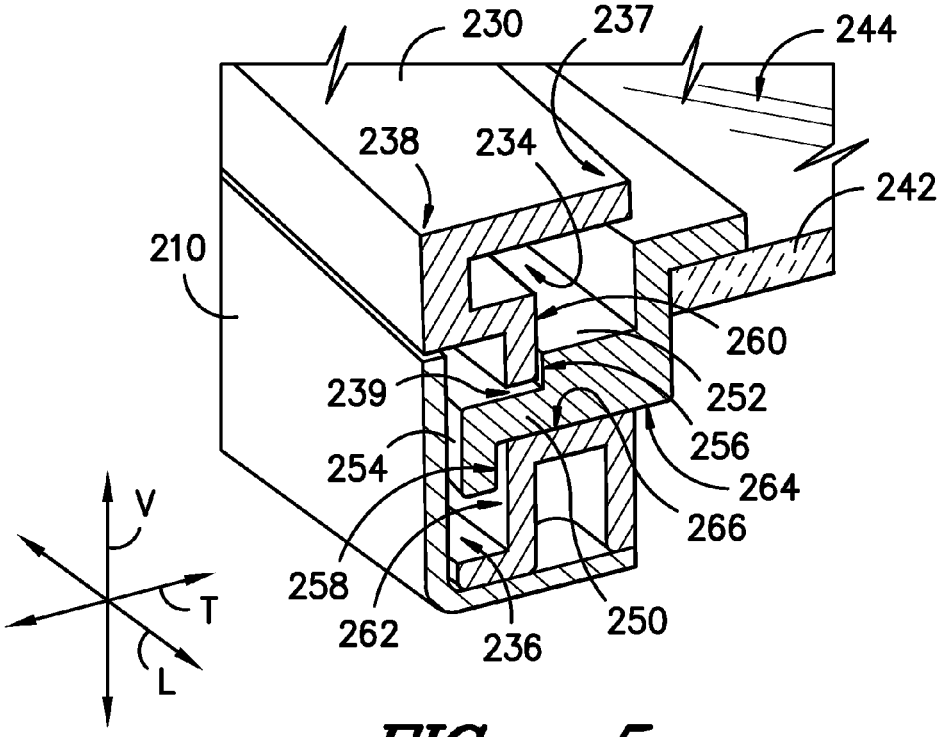
FIG. –5–
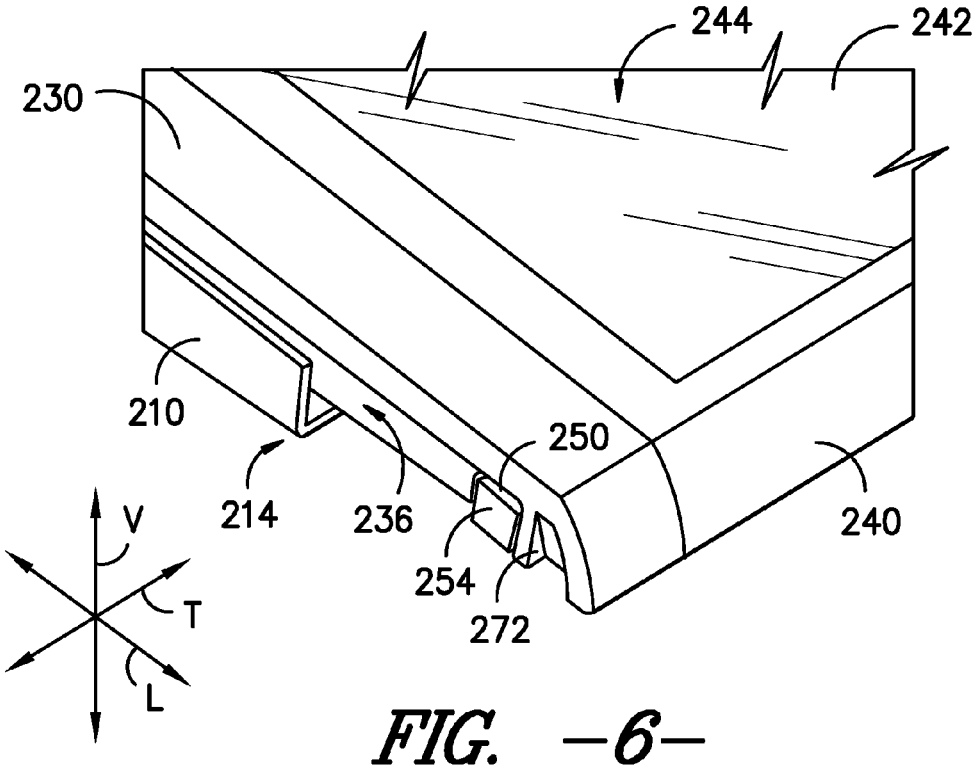
FIG. –6–

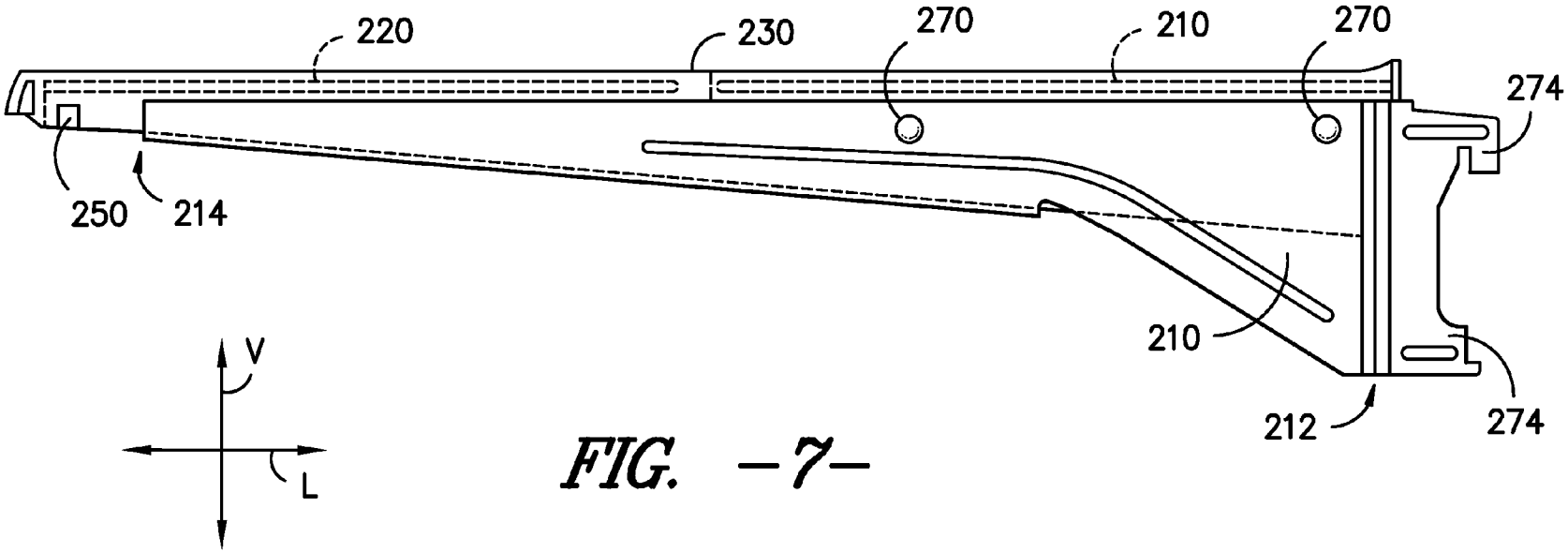
FIG. —7—

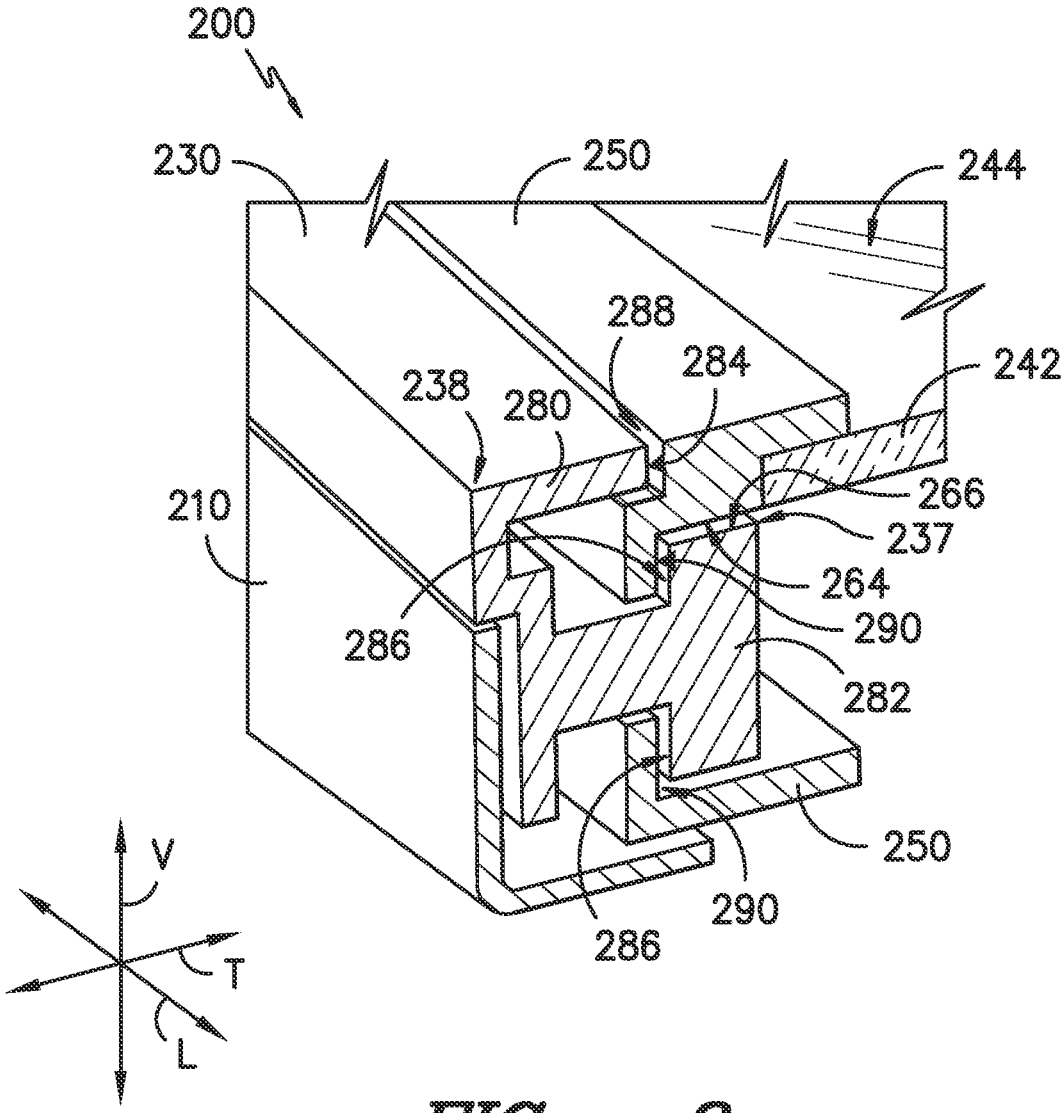
FIG. —8—

REFRIGERATOR APPLIANCE AND A SHELF ASSEMBLY FOR THE SAME

FIELD OF THE INVENTION

The present subject matter relates generally to refrigerator appliances and shelf assemblies for the same.

BACKGROUND OF THE INVENTION

Refrigerator appliances generally include a cabinet that defines a chilled chamber for receipt of food items for storage. Refrigerator appliances also generally include various combinations of shelves, bins, and drawers positioned within the chilled chamber to assist with storage of food items therein. Certain refrigerator appliances include adjustable shelves that permit an appliance user to adjust the shelves between various configurations. For example, adjustable shelves can permit the appliance user to adjust a height or a length of the shelves.

Certain adjustable shelves include a fixed glass plate and a movable glass plate that can slide below the fixed glass plate. Such adjustable shelves can include brackets that support the glass plates within the chilled chamber. Generally, such brackets are connected to each other with cross-bars that extend between the brackets below the glass plates.

Adjustable shelves having cross-bars have certain drawbacks. For example, cross-bars can consume valuable storage space below the adjustable shelves. Also, cross-bars can be visually unappealing or unattractive. Further, cross-bars can be expensive and add to the overall cost of the refrigerator appliance.

Accordingly, a refrigerator appliance with features for securely and reliably mounting an adjustable shelf within a refrigerator appliance would be useful. In particular, a refrigerator appliance with features for mounting an adjustable shelf within a refrigerator appliance that does not require cross-bars would be useful.

BRIEF DESCRIPTION OF THE INVENTION

The present subject matter provides a shelf assembly for a refrigerator appliance. The shelf assembly includes a pair of brackets, a fixed shelf mounted to the pair of brackets, and a movable shelf. The shelf assembly also includes features for slidably mounting the movable shelf to said fixed shelf and for limiting movement of the movable shelf along a transverse direction. Additional aspects and advantages of the invention will be set forth in part in the following description, or may be apparent from the description, or may be learned through practice of the invention.

In a first exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet that defines a chilled chamber for receipt of food items for storage. The cabinet extends between a front portion and a back portion along the lateral direction. The cabinet has a back wall positioned at the back portion of the cabinet and defines an opening for accessing the chilled chamber of the cabinet at the front portion of the cabinet. A shelf assembly is positioned within the chilled chamber of the cabinet. The shelf assembly includes a pair of brackets mounted to the cabinet at the back wall of the cabinet. The brackets of the pair of brackets are spaced apart from each other along the transverse direction. A fixed shelf is mounted to the pair of brackets. The fixed shelf has a pair of guides that extend along the lateral direction. Each guide of the pair of guides is positioned at a respective one of the pair of brackets. Each guide of the pair of guides defines a first channel and a second channel on opposite transverse sides of the guide. Each guide of the pair of guides also defines a slot that extends between and connects the first and second channels along the transverse direction. A movable shelf is slidably mounted to the fixed shelf. The movable shelf has a pair of bosses. Each boss of the pair of bosses is received within a respective slot of the pair of guides. Each boss of the pair of bosses also has a first locking portion and a second locking portion. Each first locking portion of the pair of bosses is positioned within a respective first channel of the pair of guides and engages the fixed shelf at the respective first channel of the pair of guides. Each second locking portion of the pair of bosses is positioned within a respective second channel of the pair of guides and engages the fixed shelf at the respective second channel of the pair of guides.

In a second exemplary embodiment, a shelf assembly for a refrigerator appliance is provided. The shelf assembly defines a vertical direction, a lateral direction, and a transverse direction. The vertical, lateral, and transverse directions are mutually perpendicular. The shelf assembly includes a pair of brackets spaced apart from each other along the transverse direction. A fixed shelf is mounted to the pair of brackets. The fixed shelf has a pair of guides that extend along the lateral direction. Each guide of the pair of guides is positioned at a respective one of the pair of brackets. Each guide of the pair of guides defines a first channel and a second channel on opposite transverse sides of the guide. Each guide of the pair of guides also defines a slot that extends between and connects the first and second channels along the transverse direction. A movable shelf is slidably mounted to the fixed shelf such that the movable shelf is slidable along the lateral direction relative to the fixed shelf. The movable shelf has a pair of bosses. Each boss of the pair of bosses is received within a respective slot of the pair of guides. Each boss of the pair of bosses also has a first locking portion and a second locking portion. Each first locking portion of the pair of bosses is positioned within a respective first channel of the pair of guides and engages the fixed shelf at the respective first channel of the pair of guides. Each second locking portion of the pair of bosses is positioned within a respective second channel of the pair of guides and engages the fixed shelf at the respective second channel of the pair of guides.

In a third exemplary embodiment, a shelf assembly for a refrigerator appliance is provided. The shelf assembly defines a vertical direction, a lateral direction, and a transverse direction. The vertical, lateral, and transverse directions are mutually perpendicular. The shelf assembly includes a pair of brackets spaced apart from each other along the transverse direction. A fixed shelf is mounted to the pair of brackets. The shelf assembly also includes a movable shelf and means for slidably mounting the movable shelf to the fixed shelf and for limiting movement of the shelf assembly along the transverse direction.

In a fourth exemplary embodiment, a shelf assembly for a refrigerator appliance is provided. The shelf assembly defines a vertical direction, a lateral direction, and a transverse direction. The vertical, lateral, and transverse directions are mutually perpendicular. The shelf assembly includes a pair of brackets that are spaced apart from each other along the transverse direction. A fixed shelf is mounted to the pair of brackets. The fixed shelf has a pair of guides that extend along the lateral direction. Each guide of the pair of guides is positioned at a respective one of the pair of brackets. Each guide of the pair of guides has a first tab and a second tab. The first and second tabs each have an engagement surface. The engagement surface of the first and second tabs face opposite ways along the transverse direction. A movable shelf is slidably mounted to the fixed shelf such that the movable shelf is slidable along the lateral direction relative to the fixed shelf. The movable shelf has a pair of bosses. Each boss of the pair of bosses has a first and second engagement surface. Each first engagement surface of the pair of bosses is positioned adjacent and faces a respective one of the engagement surfaces of the first tab. Each second engagement surface of the pair of bosses is positioned adjacent and faces a respective one of the engagement surfaces of the second tab.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 5 provides a partial section view of the shelf assembly taken along the 5-5 section line of FIG. 3.

FIG. 6 provides a partial perspective view of the shelf assembly of FIG. 2.

FIG. 7 provides a side elevation view of the shelf assembly of FIG. 2.

FIG. 8 provides a partial section view of a shelf assembly according to an additional exemplary embodiment of the present subject matter.

DETAILED DESCRIPTION

Figure 1:
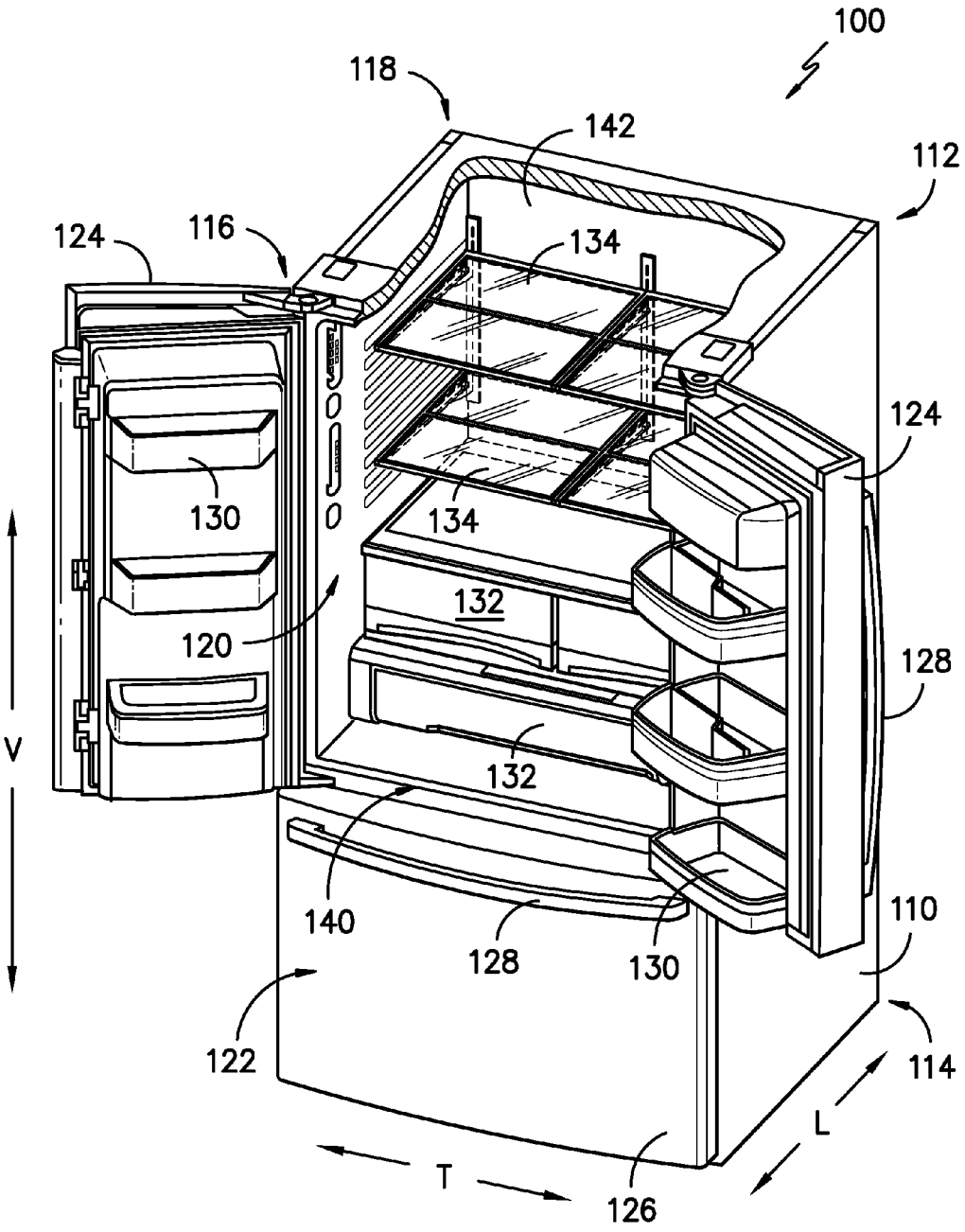
FIG. 1 provides a perspective view of a refrigerator appliance according to an exemplary embodiment of the present subject matter with doors of the refrigerator appliance shown in an open position and portions of a cabinet of the refrigerator appliance removed to reveal certain components of the refrigerator appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 defines a vertical direction V, a lateral direction L, and a transverse direction T. The vertical, lateral, and transverse directions V, L, and T are mutually perpendicular and form an orthogonal direction system.

Refrigerator appliance 100 includes a base cabinet or housing 110 that extends between a top portion 112 and a bottom portion 114 along the vertical direction V. Housing 110 defines chilled chambers for receipt of food items for storage. In particular, housing 110 defines fresh food chamber 120 positioned at or adjacent top portion 112 of housing 110 and a freezer chamber 122 arranged at or adjacent bottom portion 114 of housing 110. As such, refrigerator appliance 100 is generally referred to as a bottom mount refrigerator appliance. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Housing 110 also extends between a front portion 116 and a back portion 118, e.g., along the lateral direction L. Housing 110 defines an opening 140 for accessing fresh food chamber 120 at or adjacent front portion 116 of housing 110. Housing 110 also includes a back wall 142 positioned at or adjacent back portion 118 of housing 110.

Refrigerator doors 124 are rotatably mounted or hinged to an edge of housing 110, e.g., at front portion 116 of housing 110, for selectively accessing fresh food chamber 120. In addition, a freezer door 126 is arranged below refrigerator doors 124 for selectively accessing freezer chamber 122. Freezer door 126 is coupled to a freezer drawer (not shown) slidably mounted within freezer chamber 122. Refrigerator doors 124 are shown in an open position and freezer door 126 are shown in a closed position in FIG. 1. In the open position, refrigerator doors 124 permit access to fresh food chamber 120 through opening 140. Conversely, refrigerator doors 124 obstruct or limit access to fresh food chamber 124 through opening 140 in the closed position. Freezer door 126 operates similarly. Handles 128 can assist with adjusting refrigerator doors 124 and freezer door 126 between the open and closed positions.

Various storage components are mounted within fresh food chamber 120 to facilitate storage of food items therein as will be understood by those skilled in the art. In particular, the storage components include bins 130, drawers 132, and shelves 134 that are mounted within fresh food chamber 120. Bins 130, drawers 132, and shelves 134 are configured for receipt of food items (e.g., beverages and/or solid food items) and may assist with organizing such food items. As an example, drawers 132 can receive fresh food items (e.g., vegetables, fruits, and/or cheeses) and increase the useful life of such fresh food items.

Figure 2:
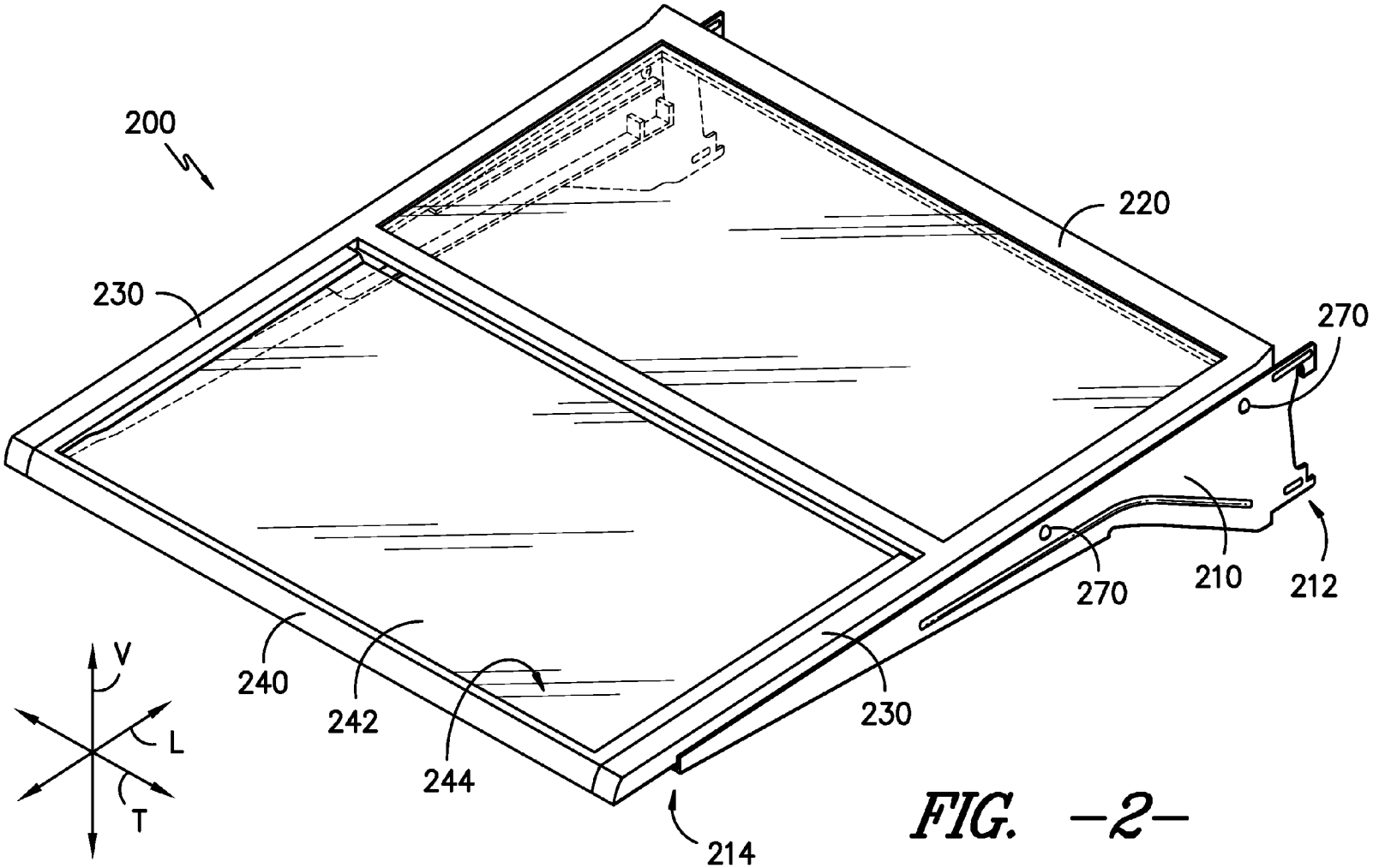
FIG. 2 provides a perspective view of a shelf assembly according to an exemplary embodiment of the present subject matter with a movable shelf of the shelf assembly shown in an extended position.
Figure 3:
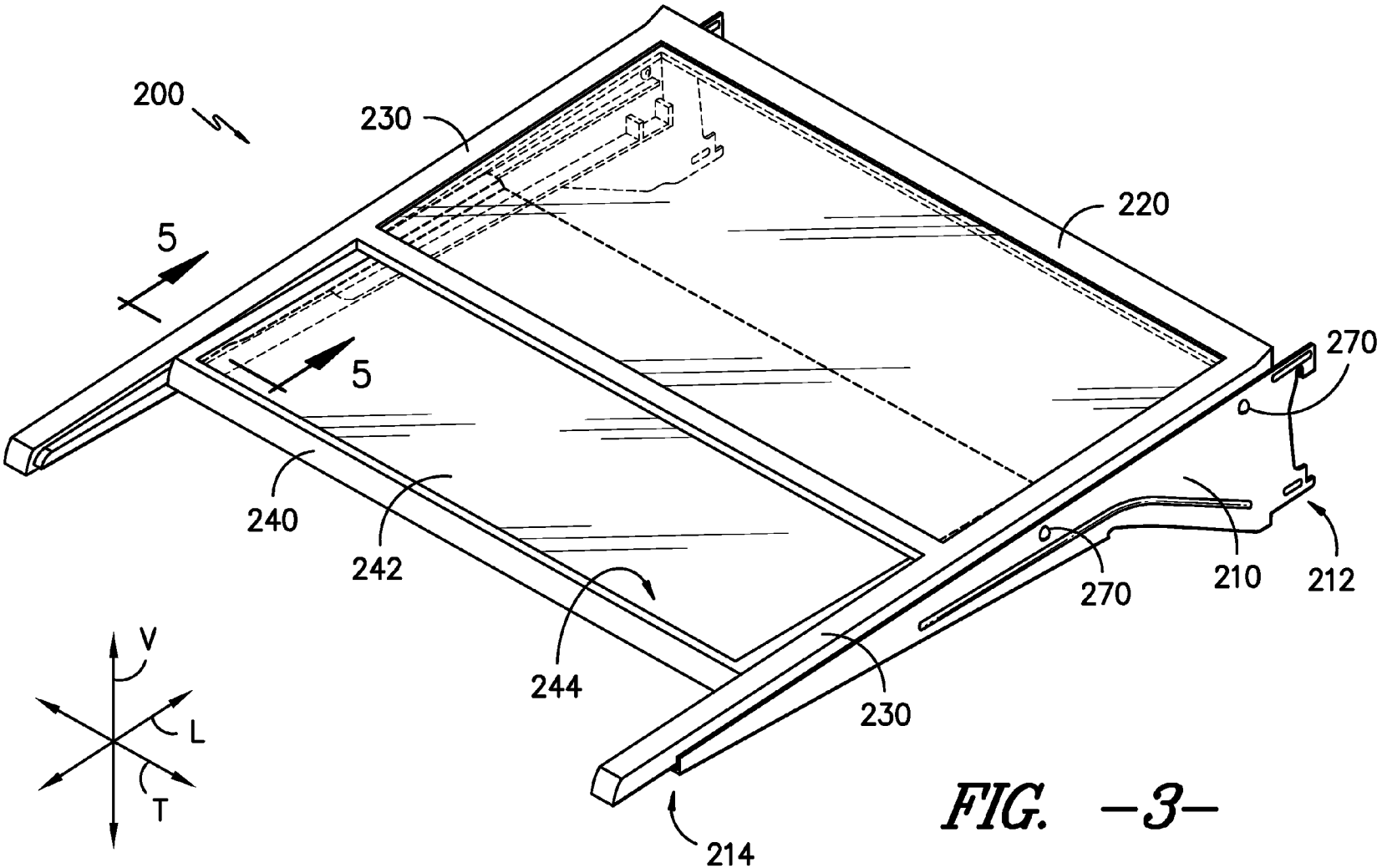
FIG. 3 provides a perspective view of the shelf assembly of FIG. 2 with the movable shelf of the shelf assembly shown in a retracted position.
Figure 4:
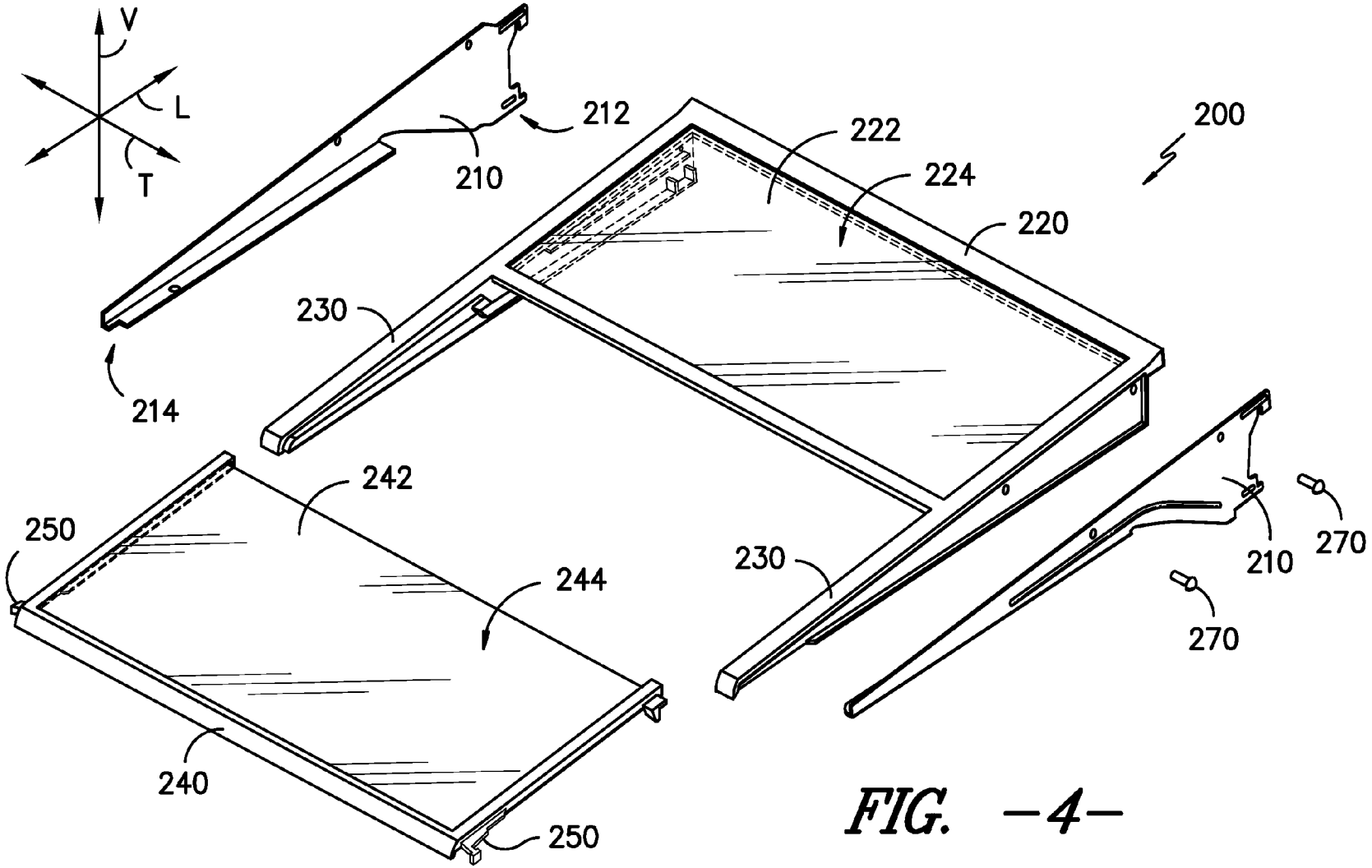
FIG. 4 provides an exploded view of the shelf assembly of FIG. 2.

FIG. 2 provides a perspective view of a shelf assembly 200 according to an exemplary embodiment of the present subject matter. FIG. 3 provides another perspective view of shelf assembly 200. FIG. 4 provides an exploded view of shelf assembly 200. Shelf assembly 200 is configured for use in any suitable refrigerator appliance. As an example, shelf assembly 200 may be positioned within fresh food chamber 120 of refrigerator appliance 100 and utilized as one of shelves 134. In FIG. 2, shelf assembly 200 is shown with a movable shelf 240 of shelf assembly 200 shown in an extended position. Conversely, in FIG. 3, shelf assembly 200 is shown with movable shelf 240 of shelf assembly 200 in a retracted position. Movable shelf 240 is discussed in greater detail below.

Shelf assembly 200 includes a pair of brackets 210. Brackets 210 are spaced apart from each other, e.g., along the transverse direction T. Brackets 210 can be mounted to cabinet 110, e.g., at back wall 142 of cabinet 110. In particular, brackets 210 extend between a distal end portion 212 and a proximal end portion 214, e.g., along the lateral direction L. Distal end portion 212 of brackets 210 can be positioned at back wall 142 of cabinet 110. Conversely, proximal end portion 214 of brackets 210 can positioned within fresh food chamber 120, e.g., adjacent front portion 116 of cabinet 110.

A fixed shelf 220 is mounted to brackets 210, e.g., at proximal end portion 214 of brackets 210. Thus, fixed shelf 220 extends between and connects brackets 210, e.g., along the transverse direction T. A plurality of fasteners 270, e.g., screws, bolts, and/or clips, couple fixed shelf 220 to brackets 210. Fixed shelf 220 includes a glass plate 222 having a top surface 224. Food items can be placed on and/or stored on top surface 224 of glass plate 222, e.g., within fresh food chamber 120. Fixed shelf 220 also has a pair of guides 230 that extend along the lateral direction L, e.g., between about distal and proximal end portions 212 and 214 of brackets 210. Each guide of guides 230 is positioned at a respective one of brackets 210.

Movable shelf 240 is slidably mounted to fixed shelf 220, e.g., at distal end portion 214 of brackets 210, and can slide relative to fixed shelf 220, e.g., along the lateral direction L. Like fixed shelf 220, movable shelf 240 includes a glass plate 242 having a top surface 244. As discussed above, movable shelf 240 is selectively adjustable between the extended position shown in FIG. 2 and the retracted position shown in FIG. 3. Food items can be placed on and/or stored on top surface 244 of glass plate 242, e.g., within fresh food chamber 120, when movable shelf 240 is in the extended position. Further, in the extended position, top surface 224 of fixed shelf 220 and top surface 244 of movable shelf 240 can be substantially coplanar, e.g., in a plane that is perpendicular to the vertical direction V. Conversely, in the retracted position, movable shelf 240 is positioned at least partially beneath fixed shelf 220, e.g., along the vertical direction V. In the retracted position, food items stored below shelf assembly 200 can extend past shelf assembly 200 along the vertical direction, e.g., due to movable shelf 240 being positioned such that movable shelf 240 does not interfere with or engage such food items.

Movable shelf 240 has a pair of bosses 250. Bosses 250 extend away from movable shelf 240, e.g., along the transverse direction T. Bosses 250 engage guides 230 in order to assist with mounting movable shelf 240 to fixed shelf 220 and hindering movement of shelf assembly 200, e.g., along the transverse direction T, as discussed in greater detail below.

FIG. 5 provides a partial section view of shelf assembly 200 taken along the 5-5 section line of FIG. 3. As may be seen in FIG. 5, guide 230 defines a first channel 234 and a second channel 236. First and second channels 234 and 236 are positioned on opposite transverse sides of guide 230. In particular, first channel 234 is positioned at or adjacent a first transverse side 237 of guide 230, and second channel 234 is positioned at or adjacent a second transverse side 238 of guide 230. First and second transverse sides 237 and 238 positioned opposite each other on guide 230 and spaced apart from each other along the transverse direction T.

Guide 230 also defines a slot 239 that extends between and connects first and second channels 234 and 236, e.g., along the transverse direction T. Boss 250 of movable shelf 240 is, e.g., slidably, received within slot 239 of guide 230. Boss 250 has a first locking portion 252 and a second locking portion 254. First locking portion 252 of boss 250 is positioned within first channel 234 of guide 230 and engages fixed shelf 220 at first channel 234. In particular, a contact surface 256 of first locking portion 252 is positioned adjacent or against a first surface 260 of guide 230. Second locking portion 254 of boss 250 is positioned within second channel 236 of guide 230 and engages fixed shelf 220 at second channel 236. In particular, a contact surface 258 of second locking portion 254 is positioned adjacent or against a second surface 262 of guide 230. First and second surfaces 260 and 262 are positioned on opposite transverse sides of guide 230, e.g., such that first and second surfaces 260 and 262 are spaced apart from each other along the transverse direction T. In particular, first surface 260 of guide 230 is positioned on or proximate first transverse side 237 of guide 230. Conversely, second surface 262 of guide 230 is positioned on or proximate second transverse side 238 of guide 230.

As discussed above, first and second locking portions 254 and 256 of boss 250 each include contact surfaces 258 and 260, respectively. Contact surface 258 of first locking portion 252 and contact surface 258 of second locking portion 254 face opposite ways, e.g., along the transverse direction T. Thus, contact surface 258 of first locking portion 252 and contact surface 258 of second locking portion 254 may face each other along the transverse direction T or may face away from each other along the transverse direction T.

Boss 250 also includes a bottom surface 264 that rests on a support surface 266 of guide 230. Bottom surface 264 of boss 250 and support surface 266 of guide 230 face each other, e.g., along the vertical direction. In such manner, boss 250 supports movable shelf 240 in the vertical direction V and assists with slidably mounting movable shelf 240 to fixed shelf 220. As an example, bottom surface 264 of boss 250 can slide on support surface 266 of guide 230 during movement of movable shelf 240 along the lateral direction L relative fixed shelf 220.

As may be seen in FIG. 5, first and second locking portions 252 and 254 of boss 250 can be spaced apart from each other, e.g., along at least one of the vertical direction V and the transverse direction T. First and second locking portions 252 and 254 are configured for hindering racking and/or movement of shelf assembly 200, e.g., in the transverse direction T. As an example, when first and second locking portions 252 and 254 engage guide 230 at both first and second channels 234 and 236 of guide 230, shelf assembly 200, brackets 210 and movable shelf 240 can be hindered from moving or permitted limited movement, e.g., in the transverse direction T, without cross-bars extending between brackets 210. Thus, by providing shelf assembly 200 with boss 250, brackets 210 can attached or mounted to fixed shelf 220 with fasteners 270 and not require any additional mechanical coupling therebetween, such as cross bars that extend between brackets 210, e.g., along the transverse direction T.

First surface 260 of guide 230 and second surface 262 of guide 230 face opposite ways, e.g., along the transverse direction T. Thus, first surface 260 of guide 230 and second surface 262 of guide 230 may face each other along the transverse direction T or may face away from each other along the transverse direction T. First surface 260 of guide 230 faces first transverse side 237 of guide 230. Conversely, second surface 262 of guide 230 faces second transverse side 238 of guide 230.

FIG. 6 provides a partial perspective view of shelf assembly 200. As may be seen in FIG. 6, boss 250 of movable shelf 240 engages a stop 272 of guide 230 in the extended position. By placing boss 250 of movable shelf 240 against stop 272 of guide 230, a user adjust movable shelf 240 between the extended and retracted positions can properly position movable shelf 240 in the extended position without over extending movable shelf 240.

FIG. 7 provides a side elevation view of shelf assembly 200. As may be seen in FIG. 7, bracket 210 includes an attachment mechanism 274. Attachment mechanism 274 can engage back wall 142 of cabinet 110 to mount shelf assembly 200 to cabinet 210. In particular, attachment mechanism can support shelf assembly 200 such that shelf assembly 200 is cantilevered into fresh food chamber 120.

FIG. 8 provides a partial section view of shelf assembly 200 according to an additional exemplary embodiment of the present subject matter. As may be seen in FIG. 8, guide 230 has a first tab 280 and a second tab 282. First and second tabs 280 and 282 are spaced apart from each other, e.g., along at least one of the vertical direction V and the transverse direction T. In particular, first tab 280 is positioned at or proximate second transverse side 238 of guide 230, and second tab 282 is positioned at or proximate first transverse side 237 of guide 230. First and second tabs 280 and 282 are configured for engaging boss 250 of shelf assembly 200 and, e.g., hindering movement of movable shelf 240 along the transverse direction T, as discussed in greater detail below.

First tab 280 has a locking surface 284. Second tab 282 also has a locking surface or surfaces 286. Locking surface 284 of first tab 280 and locking surface 286 of second tab 282 face opposite ways, e.g., along the transverse direction T. Thus, locking surface 284 of first tab 280 and locking surface 286 of second tab 282 may face each other along the transverse direction T or may face away from each other along the transverse direction T. Locking surface 284 of first tab 280 faces first transverse side 237 of guide 230. Conversely, locking surface 286 of second tab 282 faces second transverse side 238 of guide 230.

Boss 250 of movable shelf 240 includes a first engagement surface 288 and a second engagement surface or surfaces 290. First and second engagement surfaces 288 and 290 face opposite ways, e.g., along the transverse direction T. Thus, first engagement surface 288 and second engagement surface 290 may face each other along the transverse direction T or may face away from each other along the transverse direction T. First engagement surface 288 of boss 250 is positioned adjacent and faces locking surface 284 of first tab 280. Conversely, second engagement surface 290 of boss 250 is positioned adjacent and faces locking surface 286 of second tab 282.

As discussed above, boss 250 can engage guide 230 to hinder movement of movable shelf 240, e.g., along the transverse direction T. As an example, first engagement surface 288 of boss 250 may slide on or against locking surface 284 of first tab 280 and second engagement surface 290 of boss 250 may slide on or ride against locking surface 286 of second tab 282. In such a manner, first and second tabs 280 and 282 can assist with hindering or limiting movement of movable shelf 240 and racking of shelf assembly 200, e.g., in the transverse direction T without cross-bars extending between brackets 210. Boss 250 also includes bottom surface 264 that rests on support surface 266 of guide 230, e.g., in order to assist with slidably mounting movable shelf 240 to fixed shelf 220. Thus, boss 250 can assist with hindering or limiting movement of movable shelf 240 and racking of shelf assembly 200 in the transverse direction T, and boss 250 can also assist with slidably mounting movable shelf 240 to fixed shelf 220. By providing shelf assembly 200 with boss 250, brackets 210 can attached or mounted to fixed shelf 220 with fasteners 270 and not require any additional mechanical coupling therebetween, such as cross bars that extend between brackets 210, e.g., along the transverse direction T.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, the refrigerator appliance defining a vertical direction, a lateral direction, and a transverse direction, the vertical, lateral, and transverse directions being mutually perpendicular, the refrigerator appliance comprising:

a cabinet that defines a chilled chamber for receipt of food items for storage, said cabinet extending between a front portion and a back portion along the lateral direction, said cabinet having a back wall positioned at the back portion of said cabinet and defining an opening for accessing the chilled chamber of said cabinet at the front portion of said cabinet; and a shelf assembly positioned within the chilled chamber of said cabinet, said shelf assembly comprising a pair of brackets mounted to said cabinet at the back wall of said cabinet, said pair of brackets spaced apart from each other along the transverse direction;

a fixed shelf mounted to said pair of brackets, said fixed shelf having a pair of guides that extend along the lateral direction, each guide of the pair of guides positioned at a respective one of said pair of brackets, each guide of the pair of guides defining a first channel and a second channel on opposite transverse sides of the guide, each guide of the pair of guides also defining a slot that extends between and connects the first and second channels along the transverse direction; and a movable shelf slidably mounted to said fixed shelf, said movable shelf having a pair of bosses, each boss of the pair of bosses received within a respective slot of the pair of guides, each boss of the pair of bosses also having a first locking portion and a second locking portion, each first locking portion of the pair of bosses positioned within a respective first channel of the pair of guides and engaging said fixed shelf at the respective first channel of the pair of guides, each second locking portion of the pair of bosses positioned within a respective second channel of the pair of guides and engaging said fixed shelf at the respective second channel of the pair of guides.

2. The refrigerator appliance of claim 1, wherein the first locking portions of the pair of bosses and the second locking portions of the pair of bosses are spaced apart from one another along the vertical direction.

3. The refrigerator appliance of claim 1, wherein the first locking portions of the pair of bosses and the second locking portions of the pair of bosses are spaced apart from one another along the transverse direction.

4. The refrigerator appliance of claim 1, wherein said pair of brackets extends between a distal end portion and a proximal end portion along the lateral direction, said fixed shelf positioned at the proximal end portion of said pair of brackets, said movable shelf positioned at the distal end portion of said pair of brackets.

5. The refrigerator appliance of claim 4, wherein the distal end portion of said pair of brackets is positioned at the back wall of said cabinet.

6. The refrigerator appliance of claim 4, wherein the proximal end portion of said pair of brackets is positioned proximate the front portion of said cabinet.

7. The refrigerator appliance of claim 1, wherein said movable shelf is selectively adjustable between a retracted position and an extended position, said movable shelf positioned at least partially beneath said fixed shelf along the vertical direction in the retracted position, top surfaces of said fixed and movable shelves being substantially coplanar in the extended position.

8. The refrigerator appliance of claim 1, wherein said shelf assembly further comprises a plurality of fasteners coupling said pair of brackets to said fixed shelf, the brackets of said pair of brackets not connected to each other with a cross-bar.

9. The refrigerator appliance of claim 1, wherein the first and second locking portions are configured for hindering racking of said shelf assembly in the transverse direction.

10. A shelf assembly for a refrigerator appliance, the shelf assembly defining a vertical direction, a lateral direction, and a transverse direction, the vertical, lateral, and transverse directions being mutually perpendicular, the shelf assembly comprising:

a pair of brackets spaced apart from each other along the transverse direction;

a fixed shelf mounted to said pair of brackets, said fixed shelf having a pair of guides that extend along the lateral direction, each guide of the pair of guides positioned at a respective one of said pair of brackets, each guide of the pair of guides defining a first channel and a second channel on opposite transverse sides of the guide, each guide of the pair of guides also defining a slot that extends between and connects the first and second channels along the transverse direction; and a movable shelf slidably mounted to said fixed shelf such that said movable shelf is slidable along the lateral direction relative to said fixed shelf, said movable shelf having a pair of bosses, each boss of the pair of bosses received within a respective slot of the pair of guides, each boss of the pair of bosses also having a first locking portion and a second locking portion, each first locking portion of the pair of bosses positioned within a respective first channel of the pair of guides and engaging said fixed shelf at the respective first channel of the pair of guides, each second locking portion of the pair of bosses positioned within a respective second channel of the pair of guides and engaging said fixed shelf at the respective second channel of the pair of guides.

11. The shelf assembly of claim 10, wherein the first locking portions of the pair of bosses and the second locking portions of the pair of bosses are spaced apart from one another along the vertical direction.

12. The shelf assembly of claim 10, wherein the first locking portions of the pair of bosses and the second locking portions of the pair of bosses are spaced apart from one another along the transverse direction.

13. The shelf assembly of claim 10, wherein said pair of brackets extends between a distal end portion and a proximal end portion along the lateral direction, said fixed shelf positioned at the proximal end portion of said pair of brackets, said movable shelf positioned at the distal end portion of said pair of brackets.

14. The shelf assembly of claim 10, wherein said movable shelf is selectively adjustable between a retracted position and an extended position, said movable shelf positioned at least partially beneath said fixed shelf along the vertical direction in the retracted position, said fixed and movable shelves being substantially coplanar in the extended position.

15. The shelf assembly of claim 10, further comprising a plurality of fasteners coupling said pair of brackets to said fixed shelf, the brackets of said pair of brackets not connected to each other with a cross-bar.

16. The shelf assembly of claim 10, wherein the first and second locking portions are configured for hindering racking of the shelf assembly in the transverse direction.

17. A shelf assembly for a refrigerator appliance, the shelf assembly defining a vertical direction, a lateral direction, and a transverse direction, the vertical, lateral, and transverse directions being mutually perpendicular, the shelf assembly comprising:

a pair of brackets spaced apart from each other along the transverse direction;

a fixed shelf mounted to said pair of brackets, said fixed shelf having a pair of guides that extend along the lateral direction, each guide of the pair of guides positioned at a respective one of said pair of brackets, each guide of the pair of guides having a first tab and a second tab, the first and second tabs each having an engagement surface, the engagement surfaces of the first and second tabs facing opposite ways along the transverse direction; and a movable shelf slidably mounted to said fixed shelf such that said movable shelf is slidable along the lateral direction relative to said fixed shelf, said movable shelf having a pair of bosses, each boss of the pair of bosses having a first and second engagement surface, each first engagement surface of the pair of bosses positioned adjacent and facing a respective one of the engagement surfaces of the first tab, each second engagement surface of the pair of bosses positioned adjacent and facing a respective one of the engagement surfaces of the second tab.

* * * * *